US008309889B2

(12) United States Patent
Graham

(10) Patent No.: US 8,309,889 B2
(45) Date of Patent: Nov. 13, 2012

(54) ELECTRICAL CIRCUIT

(75) Inventor: Thomas Graham, Ocean, NJ (US)

(73) Assignee: Component Hardware Group, Inc., Lakewood, NJ (US)

( * ) Notice: Subject to any disclaimer, the term of this patent is extended or adjusted under 35 U.S.C. 154(b) by 314 days.

(21) Appl. No.: 12/798,928

(22) Filed: Apr. 14, 2010

(65) Prior Publication Data

US 2011/0253695 A1 Oct. 20, 2011

(51) Int. Cl.
*H05B 1/00* (2006.01)

(52) U.S. Cl. ..... 219/220; 219/497; 219/505

(58) Field of Classification Search ..... 219/220, 219/285, 391, 395, 397, 414, 445.1, 481–496, 219/506; 374/111, 131, 141, 160–162
See application file for complete search history.

(56) References Cited

U.S. PATENT DOCUMENTS 2,980,896 A * 4/1961 Robertson et al. ..... 340/580
4,278,874 A * 7/1981 Cole ..... 219/505
4,345,145 A * 8/1982 Norwood ..... 219/492

* cited by examiner

*Primary Examiner* — Marcos D. Pizarro
*Assistant Examiner* — Suian Tang
(74) *Attorney, Agent, or Firm* — Francis B. Hand; Carella, Byrne, Cecchi

(57) ABSTRACT

An indicating lamp is provided on the exterior of a vent port to indicate failure of a heater within the vent port. An electrical circuit is provided to energize the indicating lamp in response to failure of one or the other of a pair of heaters within the vent port.

4 Claims, 3 Drawing Sheets

ELECTRICAL CIRCUIT

This invention relates to an electrical circuit. More particularly, this invention relates to an electrical circuit for a warning light.

As is known, vent ports have been used on large coolers and freezers in order to equalize the atmospheric pressure inside the units. As the air inside a cooler or freezer drops in temperature, the air contracts causing a slight vacuum relative to the air pressure outside of the unit. The vent port permits a controlled amount of outside air to enter the unit as the air contracts; typically, by means of an elastomeric "flap" valve or a spring loaded or weight loaded rigid valve in order to equalize the pressure. This type of valve also permits air to enter as the door to the unit is pulled open making the door easier to open.

Additionally, if two oppositely directed valves are used, the vent port will also permit air to be let out as the door of the cooler or freezer is closed in addition to allowing air in as the door is opened, thus decreasing the operator effort to use the door.

Since these valves are at an interface of the cold inside air and the warmer outside air, moisture condensate often develops at the valve, particularly, if the valve is not tightly closed. This condensate can freeze and the resulting ice prevents operation of the valves. In order to prevent this, an electric heater is located on or adjacent to the valves to prevent ice from forming and causing the valves to malfunction. Typically, the heaters are mounted within a section of the vent port that is covered by a louvered cover and a screen.

However, these electric heaters are prone to failure and, generally, the only way to check the heaters is to access the vent port and then remove the louvered cover and screen to be able to examine the interior where the heaters are mounted. In some larger coolers and freezers, there are several vent ports further complicating the process of checking the electric heaters.

Accordingly, it is an object of the invention to provide a simple and reliable indicator for signaling the failure of an electrical heater in a vent port.

It is another object of the invention to provide a simple electrical circuit for a failure-indicating light of a vent port.

Briefly, the invention provides an indicating lamp for indicating a failure of one or the other of the pair of electric heaters in a vent port, such as, a vent port for a refrigerated cabinet described in U.S. patent application Ser. No. 12/653,242, filed Dec. 10, 2009. As described therein, the vent port utilizes a pair of apertured metal brackets, a pair of flaps for opening and closing of the apertures for the passage of air and electric heaters to heat the brackets to melt any accumulation of ice thereon.

In accordance with the invention, an electrical circuit is provided for illuminating the indicating lamp in response to the failure of a heater. This makes the failure of a heater immediately apparent upon a cursory inspection of the refrigerated cabinet, e.g. a cooler or freezer, using a minimum number and cost of components.

The electrical circuit is connected with a supply line, such as a 120 volt line, that supplies a voltage to the electric heaters which are connected in series across the supply line.

The indicating lamp, such as a neon bulb, a bipolar LED, or a pair of LEDs, has a first lead electrically connected to a tap between the two electric heaters. A second lead of the indicating lamp is connected to a pair of diodes, each of which is electrically connected in series with one of the pair of resistors and the supply line.

The electric circuit functions so that during operation of the electric heaters of the vent port, the voltage to the indicating lamp is maintained below a predetermined starting level due to the relatively low resistance of the heaters so that the lamp remains dark. However, in response to failure of a either one of the heaters, a higher voltage passes through one of the diodes, the resistor electrically connected to that diode, the indicating lamp and the other of the heaters to effect illumination of the lamp.

The two diodes of the electrical circuit are placed back-to-back, and function as blocking diodes to enable the indicating lamp to access either side of the 120 volt line so that both electric heaters are monitored and to become illuminated if either one of the heaters fail.

In the event that both heaters fail, the indicating lamp will not be illuminated. This takes into account that the probability that both heaters will fail at exactly the same time is very remote. Even should a power surge occur sufficient to blow out the heaters, one heater will always be lower in resistance than the other due to manufacturing tolerances, typically specified at +/−5%, and that one would fail first, immediately dropping current through the other one so that the latter heater will not also blow out.

These and other objects and advantages of the invention will become more apparent from the following detailed description taken in conjunction with the drawings wherein.

Figure 1:
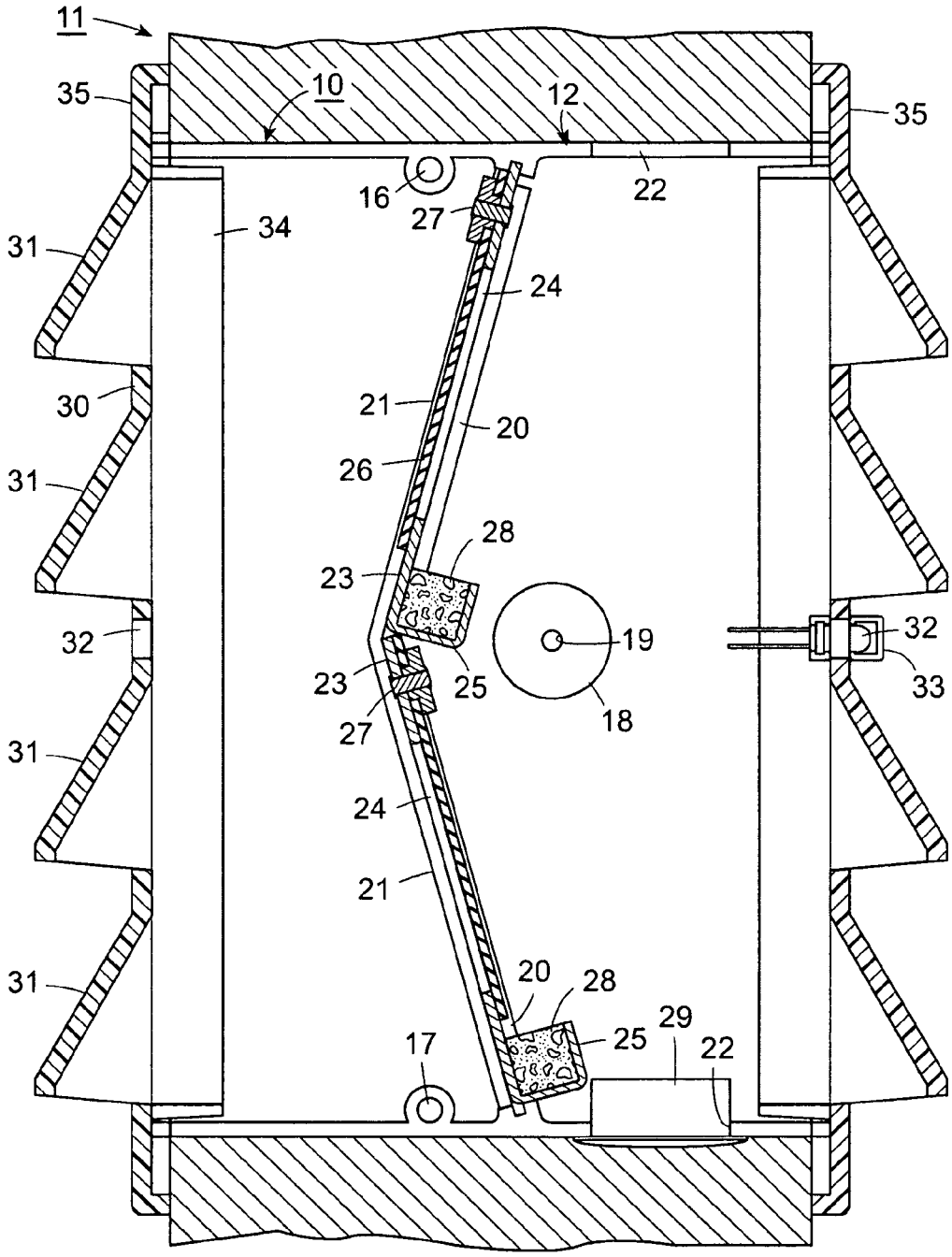
FIG. 1 illustrates a cross-sectional view of a vent port mounted in a door jam in accordance with the invention.

Referring to FIG. 1, the vent port 10 is mounted in a door jamb 11 of a door of a refrigerated cabinet, such as a refrigerated cooler or freezer (not shown), and is of a construction as described in U.S. patent application Ser. No. 12/653,242, filed Dec. 10, 2009, the disclosure of which is incorporated herein.

The vent port 10 has a housing 12 that is sized to fit within the door jamb 11 and that is formed of a pair of plastic parts 13 that are secured together in mating relation to define a space therebetween.

Figure 3:
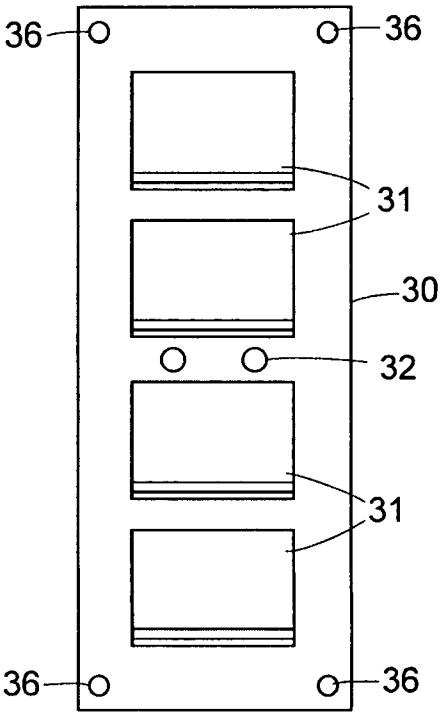
FIG. 3 illustrates a side view of the housing part of FIG. 2.
Figure 2:
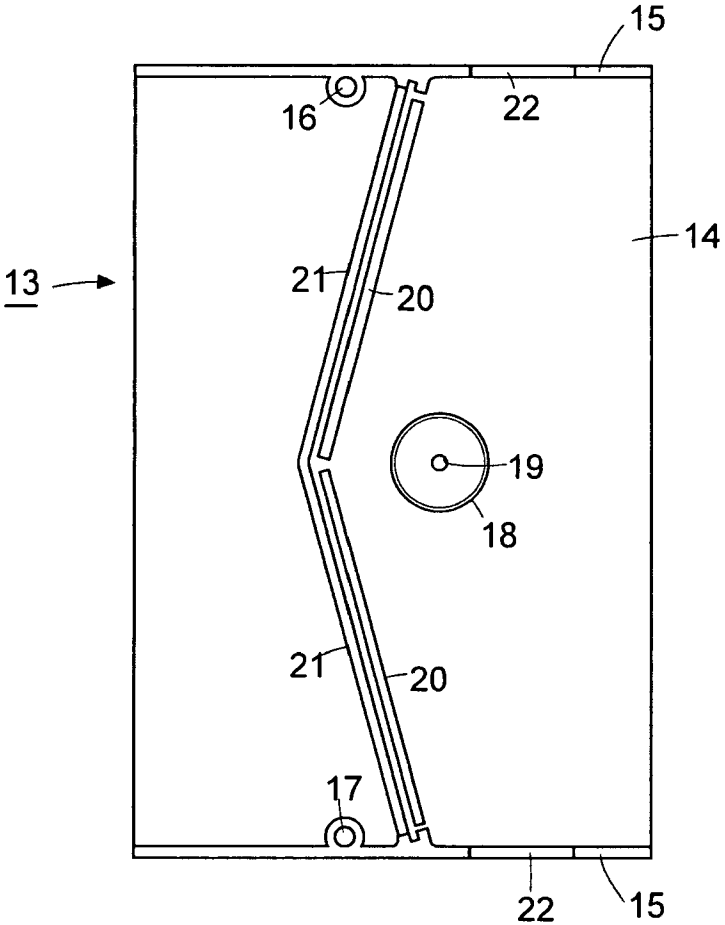
FIG. 2 illustrates a front view of a housing part of the vent port.

Referring to FIGS. 2 and 3, each housing part 13 is sized to fit into the door jamb 11 (see FIG. 1) and each has a flat wall 14 of rectangular shape and a pair of oppositely disposed flanges 15 on the wall to define a channel-shaped cross-section. One flange 15 carries a pin (not shown) for sliding into a bore (not shown) in the other flange 15 in order to mate the parts together.

As illustrated, the wall 14 of each housing part 13 is provided with an enlarged boss 18 that projects toward the other part (not shown) and has an aperture 19 through which a securing means, such as a screw, may be passed for securing the two housing parts 13 together. In addition, the wall 14 of each housing part 13 is provided with two pairs of integral walls 20, 21 that define a slot therebetween and that project from the wall 14 approximately 0.188 inches.

Each flange 15 of the housing part 13 is provided with a semi-circular recess 22 for the passage of an electrical line.

Referring to FIG. 1, the vent port 10 is also provided with a pair of brackets 23 that are made of a heat conducting metal, such as, aluminum, and that are mounted in the slots between the walls 20, 21 of the housing 12 in vertical alignment relative to each other, as viewed. Each bracket 23 is disposed at an acute angle relative to a vertical plane.

Each bracket 23 is of rectangular construction and is of a width to fit between the respective walls 20, 21 of each housing part 13. In addition, each bracket 23 has an aperture 24, for example, of rectangular shape for the passage of air, and a bottom edge that is turned upwardly in order to define a channel 25.

The vent port 10 also has a pair of flaps 26, each of which is mounted on a respective bracket 23 in overlying relation to the aperture 24 therein for movement between a first position, as shown, in abutment with the bracket 23 in order to close the aperture 24 and a second position (not shown) spaced from the aperture 24 to allow passage of air therethrough.

Each flap 26 is of a shape compatible with the shape of the aperture 24 in order to close the aperture 24 to the flow of air when the flap 26 is in the closed position. For example, each flap 26 is of rectangular shape and is secured by a pair of rivets 27 to an upper section of the respective bracket 23. Each flap 26 is made of silicone rubber and acts as a closure valve over the venting aperture 24.

The vent port 10 also has a pair of electric heaters in the form of resistors 28, each of which is mounted in a channel 25 of a respective bracket 23 for generating and delivering heat into the bracket 23 sufficient to melt ice thereon. Each resistor 28 is of a metallic element type that uses a low wattage, for example 4 watts at 120 volts. This type of resistor is called "flame proof" and/or "sand block" or "cement" in the electronics field. The resistors 28 are off the shelf items and are widely used in the electronics industry. Each resistor 28 consists of a rectangular ceramic body into which is placed a wound wire or a metal film resistor element and then sealed shut with a ceramic potting mixture.

The resistors 28 are mounted in the channels 25 of the brackets 23 and heat the brackets 23 because of the power they dissipate. Thus, the heat is applied more precisely to where the heat is needed and less wattage is required and less heat is wasted.

When the two housing parts 13 are mated, the recesses 22 define an aperture, for example of ⅞ inch diameter, at the top and bottom of the vent port 10. Either aperture may accept a standard one-half inch electrical conduit or a grommet (not shown). The unused aperture is then plugged with a suitable plug closure 29. (see FIG. 1).

The electrical line that is fit into the aperture 22 passes through the door jamb 11 in a suitable manner from a power source (not shown) and is connected to the resistors 28 in order to deliver electrical energy thereto.

In addition, an indicating lamp 32 is mounted on the exterior of the vent port 10 within a transparent or translucent housing 33 in order to indicate a failure of a resistor 28 (heater).

Figure 4:
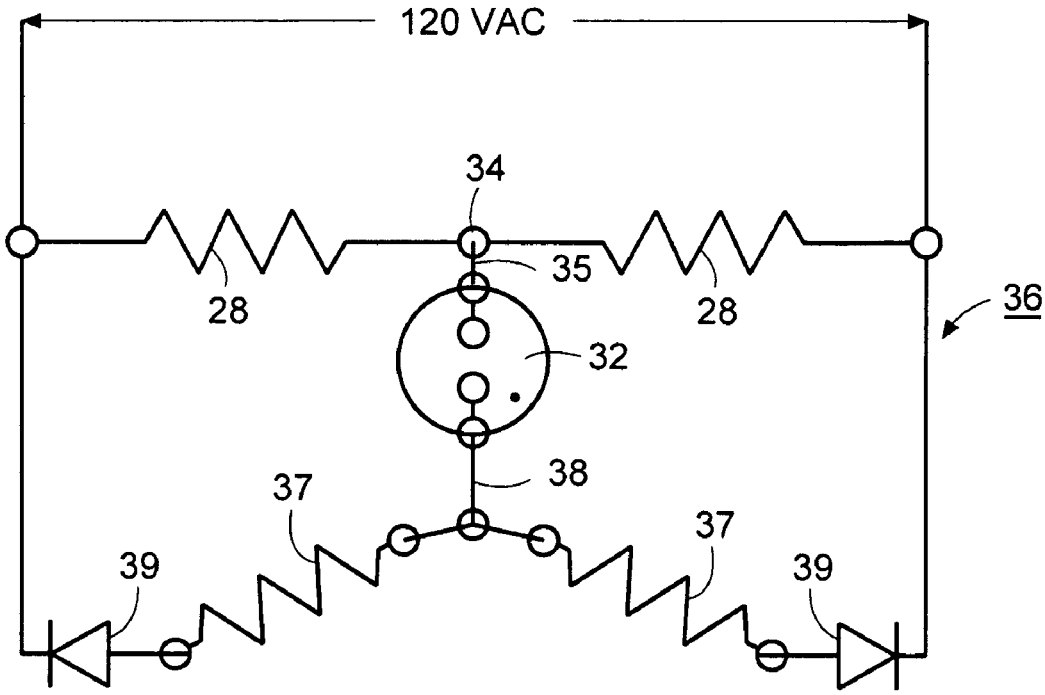
FIG. 4 illustrates a schematic view of an electrical circuit in accordance with the invention.

Referring to FIG. 4, as shown, the two resistors 28 are electrically connected in series across a supply voltage line and have a tap 34 therebetween electrically connected to the indicating lamp 32 via a lead 35. In addition, an electrical circuit 36 is provided to illuminate the lamp 32 in response to one or the other of the resistors 28 failing to heat.

The electrical circuit 36 has a pair of resistors 37 electrically connected in parallel to a second lead 38 of the lamp 32 and a pair of diodes 39 each of which is electrically connected between a respective one of the resistors 37 and the voltage line. As indicated, each resistor 37 is electrically connected to one cathode (or one anode) of a respective diode 39 while the other leads of the diodes 39 are connected to the supply voltage line. For example, each resistor 37 is a 30,0000Ω ½ Watt flame proof metal film and, for example, each diode 39 is a 1N486B diode or other specification capable of handling the current and reverse voltage.

Each resistor 37 functions as a current-limiting resistor in series with the lamp 32 while the diodes 39 are placed back-to-back to function as blocking diodes to prevent current flow from the voltage line through resistors 37, and to enable the lamp 32 to access either side of the voltage line so that both resistors 28 (heaters) are monitored and the lamp 32 will illuminate should either of the resistors 28 (heaters) fail.

During operation of the resistors 28 (heaters), the voltage to the lamp 32 is maintained below a predetermined breakdown voltage, e.g. 95 VAC.

In response to failure of one or the other of the resistors 28 (heaters), the voltage passes through the diode 39 and resistor 37 associated with that resistor 28 (heater) and through the lamp 32 to the other of the resistors 28 (heaters) to effect illumination of the lamp 32. Where the lamp 32 is a neon bulb, the voltage now becomes sufficiently high to ionize the gas in the neon bulb and, thus, illuminate the bulb indicating that a resistor 28 (heater) has failed. The "breakdown" voltage for a standard neon bulb is usually 65 volts AC. In this application, a higher voltage is required because of the particular value of the heating resistors 28 to achieve the target wattage and maximum temperature limits. Hence, use is made of a A-1C bulb which has trace amounts of other gases added to the neon to achieve the higher breakdown voltage (95 VAC).

The indicating lamp 32 may also be a bipolar LED or a pair of LEDs placed in parallel in opposite polarity with suitably changed resistor 37 values. In each of these embodiments, the voltage delivered through the lamp 32 in response to failure of a resistor 28 (heater) is sufficient to illuminate the LED(s).

The invention thus provides a simple and reliable structure for indicating the failure of a heater within a vent port or a cooler or freezer.

What is claimed is:

1. In combination, two supply voltage lines;

a pair of electric heaters electrically connected in series across said voltage lines and having a tap therebetween;

an indicating lamp having a first lead electrically connected to said tap for indicating a failure of one of said pair of electric heaters; and an electrical circuit including a pair of resistors connected to a second lead of said lamp; and a pair of diodes, each said diode being electrically connected in series with a respective one of said resistors to form a resistor-diode pair, each said resistor-diode pair being electrically connected said second lead of said lamp and said voltage line whereby during operation of said electric heaters voltage to said lamp is maintained below a predetermined starting level and in response to failure of a respective one of said heaters, voltage passes through one of said diodes, said respective resistor, said lamp and the other of said heaters to effect illumination of said lamp.

2. The combination as set forth in claim 1 wherein said indicating lamp is a neon bulb.

3. The combination as set forth in claim 1 wherein said diodes are disposed in back-to-back relation to enable access of said lamp to either side of said voltage line and to prevent current flow from said voltage line through said resistors.

4. The combination as set forth in claim 1 wherein each resistor is a current limiting resistor.

* * * * *